United States Patent [19]

Landa

[11] Patent Number: 4,582,774

[45] Date of Patent: Apr. 15, 1986

[54] LIQUID DEVELOPING LATENT ELECTROSTATIC IMAGES AND GAP TRANSFER

[75] Inventor: Benzion Landa, Edmonton, Canada

[73] Assignee: Savin Corporation, Stamford, Conn.

[21] Appl. No.: 680,595

[22] Filed: Dec. 11, 1984

Related U.S. Application Data

[63] Continuation of Ser. No. 250,720, Apr. 3, 1981, abandoned.

[51] Int. Cl.[4] ..... G03G 13/16; G03G 13/10

[52] U.S. Cl. ..... 430/126; 430/115

[58] Field of Search ..... 430/112, 115, 126

[56] References Cited

U.S. PATENT DOCUMENTS

| | | | |
|---|---|---|---|
| 3,336,906 | 8/1967 | Michalchik | 430/112 X |
| 3,766,072 | 10/1973 | Metcalfe et al. | 430/115 X |
| 3,795,530 | 3/1974 | Gundlach | 430/112 X |
| 3,850,830 | 11/1974 | Fukushima et al. | 430/115 X |
| 3,915,874 | 10/1975 | Machida | 430/115 X |
| 4,049,446 | 9/1977 | Metcalfe et al. | 430/112 X |
| 4,413,048 | 11/1983 | Landa | 430/115 |
| 4,454,215 | 6/1984 | Landa | 430/115 |

FOREIGN PATENT DOCUMENTS

| | | | |
|---|---|---|---|
| 682502 | 3/1964 | Canada | 430/112 |

*Primary Examiner*—Roland E. Martin

*Attorney, Agent, or Firm*—Shenier & O'Connor

[57] ABSTRACT

A composition for developing latent electrostatic images comprising an aliphatic hydrocarbon carrier liquid having dispersed therethrough charged pigmented toner particles having a low charge to mass ratio. The composition has an amount of spacer particles having their smallest diameter greater than twenty microns and greatest diameter less than seventy microns disseminated therethrough. The spacer particles are adapted to form an air gap between the developed electrostatic image on a photoconductor, or dielectric support, and the medium to which the developed image is to be transferrred. The population of the spacer particles is such that their interparticle distance on the photoconductor is four millimeters or less. The spacer particles may be formed of any desired material, insoluble in the carrier liquid, and have any desired shape. A tetrahedral pyramidal shape or spherical shape is preferred.

20 Claims, No Drawings

LIQUID DEVELOPING LATENT ELECTROSTATIC IMAGES AND GAP TRANSFER

CROSS-REFERENCE TO RELATED APPLICATION

This is a continuation of co-pending application Ser. No. 250,720 filed on Apr. 3, 1981, now abandoned.

The present application is related to my application, Ser. No. 149,539, filed May 13, 1980, for "Improved Process and Apparatus for Transferring Developed Electrostatic Images to a Carrier Sheet, Improved Carrier Sheet for Use in the Process and Method of Making the Same", now U.S. Pat. No. 4,364,661, and to the application of Benzion Landa and E. Paul Charlap, Ser. No. 249,336, filed Mar. 31, 1981, for "Improved Method and Apparatus for Transferring Electrostatic Images to a Carrier Sheet", now U.S. Pat. No. 4,378,422.

BACKGROUND OF THE INVENTION

In my copending application, Ser. No. 149,539, above-identified, the latent electrostatic image is developed by electrophoresis of toner particles through a liquid carrier which is a non-toxic, light, paraffinic hydrocarbon. The freshly developed moist image is then transferred across an air gap to a carrier sheet. In the prior art, part of the carrier liquid in the non-image areas will be absorbed by the carrier sheet and must be dried, usually by heat. This evaporates hydrocarbons into the circumambient atmosphere, and the amount of evaporation permitted is strictly controlled by law. This reduces the speed at which the electrophotographic copying machine can be operated. A non-toxic, light, paraffinic hydrocarbon carrier liquid, such as ISOPAR-G (trademark of Exxon Corporation), is one of the aliphatic hydrocarbon liquids which I use in my composition. The contacting of a carrier sheet with the freshly developed image will induce smudging, smearing, or squashing of the developed image. This reduces the resolution. Then too, the charge of the toner particles is opposite to the charge of the latent electrostatic image. This arrangement is such, in the prior art, that the paper tends to stick to the photoconductive, or insulating, surface on which the image is developed. This produces difficulty in removing the carrier sheet bearing the developed image from the photoconductive surface. The usual carrier sheet is paper, and repetitive contact of paper with a moist developed image leaves paper fibers on the photoconductive surface. Since all of the developed image is rarely transferred to the carrier sheet, the paper fibers contaminate the developing liquid.

I have found, as pointed out in the copending applications, above-identified, that these disadvantages can be avoided by spacing the carrier sheet from the photoconductor to form a gap and causing the freshly developed image to negotiate the gap between the photoconductor and the carrier sheet by placing a charge on the back of the carrier sheet by means of a corona or the like.

In my copending application, now U.S. Pat. No. 4,364,661, I describe the method of transferring freshly liquid-developed images across a gap. I disclose methods of forming a gap by providing the carrier sheet with protuberances formed on the carrier sheet which prevent the contact of the major area of the carrier sheet with the freshly developed image by deforming the sheet or otherwise forming protuberances thereon. In the copending application of Benzion Landa and E. Paul Charlap, Ser. No. 249,336, there is disclosed another means of carrying out my method. We there provide spacing particles to form the desired gap between the substrate bearing the freshly developed electrostatic image by positioning them on the developed image or by forming spacing protuberances on the photoconductive, or insulating, surface on which the latent electrostatic image is formed.

I have discovered that I may accomplish substantially the same result by another means—namely, by disseminating spacer particles adapted to prevent the carrier sheet from contacting the freshly developed image in the developing composition of this invention so that these particles are spaced throughout the developed image and the background areas, thus forming the desired gap over which the transfer of the developed latent electrostatic image occurs.

1. Field of the Invention

The invention relates to an improved composition for developing latent electrostatic images by liquid toning, in which a gap is formed across which transfer takes place.

2. Description of the Prior Art

Machida, in U.S. Pat. No. 3,915,874, discloses a liquid developer for use in developing a latent electrostatic image and then transferring it to a carrier sheet by contact between the carrier sheet and the developed image in which resolution is increased by preventing crushing of the toner particles forming the developed image. He does this by suspending fine particles which are harder than the toner particles throughout the liquid carrier which is any of the known aliphatic hydrocarbon liquids used in dielectric liquid-carried toner particles forming developing liquids of the prior art. The fine anti-crushing particles employed by Machida are inorganic materials, such as glass beads, zinc oxide, titanium dioxide, silica, and the like. The average fine inorganic particles have a diameter of from $1\mu$ to $15\mu$. Machida erects a signpost to the art against the instant invention by pointing out that, above a $15\mu$ diameter of the hard, fine particles, there is an increase in white spots which destroy the image and the resolution. There is no disclosure of using spacer particles of such large size as to prevent contact between the carrier sheet and the developed image by forming a gap. The "white spots" mentioned by Machida are "holidays" in the transferred image. The "fine" particles of Machida are equal to or smaller in diameter than the toner particles, so that there is contact between the developed image and the carrier sheet to which the image is being transferred.

SUMMARY OF THE INVENTION

In general, my invention contemplates the provision of a carrier liquid comprising a low-boiling, aliphatic hydrocarbon, such as ISOPAR-G, as the liquid component of my composition. This is a narrow cut of isoparaffinic hydrocarbons having an initial boiling point of 319° F. and an end point of 345° F. It has a flash point about 100° F. I may use higher-boiling aliphatic hydrocarbon liquids, such as ISOPAR-M (trademark of Exxon Corporation), or light mineral oils, such as "Marcol 52" or "Marcol 62" (trademarks of Humble Oil & Refining Company). I disperse finely ground pigment particles which are charged. These charged particles are adapted to develop a latent electrostatic image by electrophoresis. I also disseminate larger spacer particles through the carrier liquid which act as gap-forming means to prevent the freshly developed image from contacting the carrier sheet, and which spacer particles form an air gap between the carrier sheet and the photoconductor. The size of the spacer particles is not greater than 70 microns and not less than 20 microns.

The charged toner particles of my composition have a low charge to mass ratio, so that they will form a developed image which is less compact, or less cohesive, and relatively more fluffy than and thicker than the developed images of the prior art. This is a salient feature which no one has heretofore observed. The white spots, or holidays, in the transferred image observed by Machida when his "fine particles" reached a diameter above 15 microns, were caused in part by his compact or highly viscous developed image. No worker in the prior art taught a developing liquid composition capable of developing a latent electrostatic image transferable over a gap between the image and a carrier sheet. I achieve the low charge to mass ratio in the toner particles by making the average size of the toner particles larger than the toner particles customarily used in the prior art.

OBJECTS OF THE INVENTION

One object of my invention is to provide a developing composition comprising a carrier liquid, the use of which will reduce the quantity of carrier liquid which will be evaporated from a sheet to which a developed image is transferred.

Another object of my invention is to provide an improved developing liquid composition adapted to form an air gap between the surface bearing the developed electrostatic image and a carrier sheet to which the developed image is transferred.

Still another object of my invention is to provide a developing liquid composition in which an air gap is formed between a photoconductor bearing a developed electrostatic image and sheet material, which will prevent smearing, smudging, or squashing of the developed image in the course of its transfer from the photoconductor to the sheet material.

A further object of my invention is to provide a developing liquid composition in which a gray scale is generated during the development.

A still further object of my invention is to provide a developing liquid composition, by the use of which a developed electrostatic image can be transferred from an insulating surface to rougher papers.

An additional object of my invention is to provide a developing liquid composition, by the employment of which a developed electrostatic image may be transferred to non-absorbent sheets such as those made of cellulose nitrate, cellulose acetate, hydroxy-cellulose esters, or the like.

Still another object of my invention is to provide a developing liquid in which thin lines are reproduced with greater density.

A still further object of my invention is to provide a developing liquid which will produce copies of an increased resolution on a carrier sheet.

DESCRIPTION OF THE PREFERRED EMBODIMENT

The preferred embodiment of my invention contemplates the use of a low-boiling aliphatic hydrocarbon liquid such as pointed out above. These liquids are good insulators, having a resistivity of $10^{10}$ ohm-centimeters or greater. The developing liquids of the prior art have pigmented particles of colloidal size suspended in the developing liquid. These particles may be charged in the process of preparing them or they may be charged with a charge director which gives them the desired polarity. While the prior art specifies that the toner particles may vary in size, the charge to mass ratio is always high. In preparing my liquid developing composition, I use any of the pigmented particles of the prior art, but ensure that there is a low charge to mass ratio. I accomplish this by using toner particles of larger size, of a magnitude in the order of 3 to 7 microns. The toner particles may have an average size of the order of five microns. I have observed that a low charge to mass ratio enables the toner particles to form flocs, or clumps, which are loosely associated but are readily disassociated when the developing liquid is agitated. These flocs are amorphous units which are formed by loosely associated toner particles and range in size in the order of from 8 microns to as high as 20 microns. I have found it very difficult to ascertain the size of the desired flocs, especially during their behavior in the presence of an electrostatic field. Optical microscopy does not lend itself to viewing electrophotographically developing images. In most systems for developing latent electrostatic images, the toner is agitated by pumping it from a supply to a developing zone and back to a supply. This agitation will keep the toner particles disseminated throughout the carrier liquid. The loose flocculation of toner particles which I observe indicates that there is a low charge to mass ratio, which is a necessary element of my invention. If a toner comprising a dielectric liquid and large toner particles with a low charge to mass ratio is used to develop a latent electrostatic image, the developed image will be less cohesive, less dense, and of lower viscosity than the images developed with toners of the prior art with which I have had any experience. The production of a less cohesive or fluffier toned image is one of the features which enables me to achieve the objects of my invention with that degree of excellence I desire. That is not to say that my invention cannot be practiced less efficiently as the cohesion of the developed image is increased. In photocopying machines, means are provided for reducing the quantity of developing liquid on the developed image. This may be done by doctoring means, metering means such as a reverse roller, or squeegeeing means. The quantity of toner particles which I employ may vary from between 0.1 percent to 10 percent by weight in respect of the carrier liquid. This contrasts with the usual range of toner concentration of approximately 0.1 percent to 2 percent of toner particles by weight in respect of the carrier liquid. If the development is slow, the lower level of concentration of toner can be used, but the upper limit of 2 percent cannot ordinarily be exceeded without producing discoloration of the background areas. In my process, I am enabled to employ as high as 10 percent by weight of toner particles in respect of the carrier liquid, since my image is transferred across an air gap and there will be no discoloration of the background areas. This enables a copying machine using the developing composition of my invention to be operated at a much higher speed.

After I have determined the suitable toner-particle size in the specific liquid carrier, and with due consideration of the composition of the toner particles so as to form readily disassociated flocs, I am ready to supply the liquid with spacing particles, the function of which is to form a gap between the developed image and the carrier sheet to which the image is to be transferred. I measure this gap from between the insulating surface carrying the image to the surface to which the image is to be transferred, since this gap is readily determined by the spacing particles. The maximum thickness of a developed image is usually less than 20 microns, so that there is a gap between the surface of the image and the surface of the sheet which is to receive the transferred image. The spacing particles may vary in diameter between 20 microns and 70 microns, with the preferred size being between 30 microns and 40 microns. This ensures that there will be an air gap between the top of the developed image and the carrier sheet to which the image is to be transferred.

I next determine the concentration of the spacing particles within the carrier liquid. I do this empirically by successively adding amounts of spacing particles to the carrier liquid and spreading it over a non-charged photoconductive drum by operating the drum. I then observe the interparticle distance between the spacing particles. This distance should be 4 millimeters or less. The spacing particles will be distributed uniformly over the photoconductive drum which has not been charged. The spacing particles may be made of any appropriate material which is insoluble in the carrier liquid. Typical materials are synthetic resins, such as polyacrylates, methyl methacrylate, high-density polyethylene, polycarbonate, natural starches, and the like. Even glass spheres can be used if they are not broken, since such would be very abrasive. The image areas tend to trap spacing particles to a greater degree than the non-image areas. I have found that the preferred shape of the spacing particles, from an abrasion point of view, is spherical, since these particles will tend to roll or flow more readily and therefore tend to scratch the photoconductor less than other shapes. Hard crystalline materials are highly abrasive and rapidly abrade the sensitive surface of the photoconductor. The spacing particles must survive the metering station. I have found that the overall preferred shape is a four-sided pyramid—that is, a tetrahedral pyramid which has a triangle base and three triangular sides. This shape has the advantage that, whatever its orientation, it will always offer the same spacing from the photoconductor to the carrier sheet; that is, the photoconductor will always support the base and the carrier sheet will always be supported by a point.

The quantity of spacing particles may vary from as little as 0.1 percent by weight to 10 percent by weight in respect of the carrier liquid. It will be clear to those skilled in the art that the specific gravity of most of the materials from which the spacing particles are made is larger than the specific gravity of the carrier liquid and will tend to settle out rapidly. The actual percentage of spacing particles in circulation at one time is difficult to determine, except by the empirical method I have pointed out above. Most systems draw liquid from the bottom of a sump, and the spacing particles tend to drift rapidly toward this bottom. The concentration of spacing particles, which I have determined empirically, will always produce an interparticle distance of less than 4 millimeters in the non-image areas. If the particles are of a tetrahedral pyramid shape, very few of these will be lost and carried by the transferred image.

It will be seen that I have accomplished the objects of my invention. I have provided a developing composition comprising a carrier liquid, the use of which composition reduces the amount of carrier liquid which will be transferred to sheet material and hence evaporated therefrom after the image has been transferred. My invention forms an air gap irrespective of specific apparatus or other means such as pointed out in my copending application and the copending application of Benzion Landa and E. Paul Charlap, referred to above. The use of my composition prevents smearing, smudging, or squashing of the developed image, increases the resolution, and generates a gray scale. Furthermore, I am enabled to transfer developed electrostatic images to a non-absorbent carrier sheet and can produce images of a greater density than heretofore possible with liquid-developed images.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a process for developing a latent image on an imaging surface by electrophoresis and transferring the developed image from said surface to a copy sheet, a liquid developer including in combination a normally liquid dielectric carrier, charged toner particles dispersed in said carried liquid, and dielectric particles dispersed in said carrier liquid, said dielectric particles having a size of at least twenty but less than forty microns.

2. A process as in claim 1 wherein the toner particles have an average size of the order of five microns.

3. A process as in claim 1 wherein the toner particles have a size of the order of three to seven microns.

4. A process as in claim 1 wherein the dielectric particles have a size of at least thirty microns.

5. In a process for developing a latent image on an imaging surface by electrophoresis and transferring the developed image from said surface to a copy sheet, a liquid developer including in combination a dielectric liquid carrier, charged toner particles dispersed in said carrier, the developed image on said surface having a height determined by the charge-to-mass ratio of said toner particles, and dielectric spacing particles dispersed in said carrier, said spacing particles having a size greater than said height and being operative during transfer to space the copy sheet and the imaging surface apart a distance greater than said height and provide a gap between the developed image and the copy sheet, said spacing particles having a size between twenty and seventy microns.

6. A process as in claim 5 wherein the toner particles have an average size of the order of five microns.

7. A process as in claim 5 wherein the toner particles have a size of the order of three to seven microns.

8. A process as in claim 5 wherein the concentration of spacing particles is sufficiently great that non-image areas of the imaging surface have deposited thereon spacing particles separated by distances less than four millimeters.

9. In a process for developing a latent image on an imaging surface by electrophoresis in the presence of an electrostatic field from a development electrode and transferring the developed image from said surface to a copy sheet, a liquid developer including in combination a dielectric liquid carrier, charged toner particles dispersed in said carrier, the image developed on said surface in the presence of said electrostatic field having a generally uniform height determined by the charge-to-mass ratio of said toner particles, and dielectric spacing particles dispersed in said carrier, said spacing particles having a size greater than said height and being operative during transfer to space the copy sheet and the imaging surface apart a distance greater than said height and provide a gap between the developed image and the copy sheet, said spacing particles having a size between twenty and seventy microns.

10. A process as in claim 9 wherein the toner particles have an average size of the order of five microns.

11. A process as in claim 9 wherein the concentration of spacing particles is sufficiently great that non-image areas of the imaging surface have deposited thereon spacing particles separated by distances less than four millimeters.

12. In a process for developing a latent image on an imaging surface by electrophoresis, subjecting the developed image to the metering action of a reverse roller, and transferring the metered developed image to a copy sheet, a liquid developer including in combination a dielectric liquid carrier, charged toner particles dispersed in said carrier, the image developed on said surface having a height determined by the charge-to-mass ratio of said toner particles, said reverse roller being operative to decrease the thickness of a carrier liquid layer associated with the developed image to a value less than said height, and dielectric spacing particles dispersed in said carrier, said spacing particles having a size greater than said height and being operative during transfer to space the copy sheet and the imaging surface apart a distance greater than said height and provide an air gap between the developed image and the copy sheet, said spacing particles having a size between twenty and seventy microns, said air gap being effective to reduce the quantity of carrier liquid transferred from the imaging surface to the copy sheet concomitantly with the developed image.

13. A process as in claim 12 wherein the toner particles have an average size of the order of five microns.

14. A process as in claim 12 the concentration of spacing particles is sufficiently great that non-image areas of the imaging surface have deposited thereon spacing particles separated by distances less than four millimeters.

15. In a process for developing a latent image on an imaging surface by electrophoresis in the presence of an electrostatic field from a development electrode, subjecting the developed image to the metering action of a reverse roller, and transferring the metered developed image to a copy sheet, a liquid developer including in combination a dielectric liquid carrier, charged toner particles dispersed in said carrier, the image developed on said surface in the presence of said field having a generally uniform height determined by the charge-to-mass ratio of said toner particles, said reverse roller being operative to decrease the thickness of a carrier liquid layer associated with the developed image to a value less than said height, and dielectric spacing particles dispersed in said carrier, said spacing particles having a size greater than said height and being operative during transfer to space the copy sheet and the imaging surface apart a distance greater than height and provide an air gap between the developed image and the copy sheet, said spacing particles having a size between twenty and seventy microns, said air gap being effective to reduce the quantity of carrier liquid transferred from the imaging surface to the copy sheet concomitantly with the developed image.

16. A process as in claim 15 wherein the toner particles have an average size of the order of five microns.

17. A process as in claim 15 wherein the concentration of spacing particles is sufficiently great that non-image areas of the imaging surface have deposited thereon spacing particles separated by distances less than four millimeters.

18. A process as in claim 15 wherein the toner particles have an average size of the order of five microns and wherein the concentration of spacing particles is sufficiently great that non-image areas of the imaging surface have deposited thereon spacing particles separated by distances less than four millimeters.

19. In a process for developing a latent image on an imaging surface by electrophoresis and transferring the developed image from said surface to a copy sheet, a liquid developer including in combination a dielectric liquid carrier, charged toner particles dispersed in said carrier, and dielectric particles dispersed in said carrier, said dielectric particles having a size between twenty and seventy microns, said toner particles having an average size of the order of five microns, the concentration of dielectric particles being sufficiently great that non-image areas of the imaging surface have deposited thereon dielectric particles separated by distances less than four millimeters.

20. A process as in claim 19 wherein the toner particles have a size of the order of three to seven microns.

* * * * *

UNITED STATES PATENT AND TRADEMARK OFFICE

CERTIFICATE OF CORRECTION

PATENT NO. : 4,582,774

DATED : April 15, 1986

INVENTOR(S) : Benzion Landa

It is certified that error appears in the above-identified patent and that said Letters Patent is hereby corrected as shown below:

Column 6, line 29, "carried" should read --carrier--.

Signed and Sealed this

*Twenty-second* Day of *July 1986*

[SEAL]

*Attest:*

DONALD J. QUIGG

*Attesting Officer*

*Commissioner of Patents and Trademarks*